United States Patent [19]

Blain et al.

[11] Patent Number: 4,765,442

[45] Date of Patent: Aug. 23, 1988

[54] ELEVATOR SYSTEM GRACEFUL DEGRADATION OF BANK SERVICE

[75] Inventors: Jeffrey W. Blain, Scenic Lakes Township, Sussex County; Denis D. Shah, Union; Jean Chen, Parsippany, all of N.J.

[73] Assignee: Westinghouse Electric Corp., Pittsburgh, Pa.

[21] Appl. No.: 109,639

[22] Filed: Oct. 16, 1987

[51] Int. Cl.[4] ..... B66B 1/18

[52] U.S. Cl. ..... 187/101; 187/124

[58] Field of Search ..... 187/101, 102, 124

[56] References Cited

U.S. PATENT DOCUMENTS

| | | | |
|---|---|---|---|
| 4,345,670 | 8/1982 | Kaneko et al. | 187/102 |
| 4,397,377 | 8/1983 | Husson et al. | 187/101 X |
| 4,473,133 | 9/1984 | Enriquez et al. | 187/101 |
| 4,509,143 | 4/1985 | Tajima et al. | 187/101 X |
| 4,690,243 | 9/1987 | Ichioka | 187/101 |

*Primary Examiner*—William M. Shoop, Jr.

*Assistant Examiner*—W. E. Duncanson, Jr.

*Attorney, Agent, or Firm*—J. L. Brzuszek

[57] ABSTRACT

An elevator control system and method for efficient failure control with a local area network on the traveling cable and distributed electronic control circuits in the car and proximate to the respective floors with a remote microprocessor controller for each car. A local area network communicates with the corridor fixtures in a serial signal format of input and output signals. Each remote controller includes a microprocessor based computer circuit which communicates over a multicar-link with the other and also over the local area networks for car and hall calls to implement an expanded control strategy with interactive program modes with least restrictive capability. This program interacts with programs for floor control strategy and bank control strategy for the elevator system to select the best car and the most efficient operation, despite failures which would otherwise degrade the bank operation sooner and more restrictively.

10 Claims, 4 Drawing Sheets

ELEVATOR SYSTEM GRACEFUL DEGRADATION OF BANK SERVICE

CROSS REFERENCE TO OTHER APPLICATIONS

The present application is related to the following concurrently filed U.S. patent application Ser. No. 07/109,638, by J. W. Blain, et al. and entitled "Elevator System Master Car Switching" (W.E. Case 53,767); Ser. No. 07/109,640, by J. W. Blain et al. and entitled "Elevator System Adaptive Time-Based Block Operation" (W.E. Case 53,782); and to concurrently filed on June 19, 1987, Ser. No. 07/064,915, by D. D. Shah et al. and entitled "Elevator System Monitoring Cold Oil" (W.E. Case 53,783); and Ser. No. 07/064,913, by J. W. Blain et al. and entitled "Elevator System Leveling Safeguard Control and Method" (W.E. Case 53,784), all of which are assigned to the same as the present assignee and the disclosures of which are incorporated herein by reference.

BACKGROUND OF THE INVENTION

1. Field of the Invention

This invention relates in general to traction and hydraulic elevator system with distributed control circuits, and more particularly, to a method and control system for protecting against control signal and communication failures, with diminished or excessively restrictive elevator service, because of the loss of a vital element in the system.

2. Description of the Prior Art

Computers have heretofore been pre-programmed to perform various functions in the operational control or management of car and hall call response strategies in an elevator system such as in U.S. Pat. No. 4,511,017 which provides emergency back-up elevator service, when normal service is degraded, by preassigning and revising blocks of car assignments to floors in a rotational manner.

Various arrangements for elevator bank configurations have been known to benefit from these state-of-the-art solid-state controllers, but assuming that dynamically defined tasks involve uniquely reconfigured failure mode arrangements; these have yet to emerge to a level that is highly efficient and least restrictive. Disturbingly present is the likelihood that the failure of components, assigned for dedicated control functions such as in a fixed dispatcher controller, used with the present day elevator control apparatus, will eventually interrupt or discontinue to communicate with other controllers in the system. These systems may have a back-up mode of operation with some form of service being retained, but it may be of significantly inferior quality to the normal service.

With the introduction of microprocessor based elevator controllers and the distribution of electronic circuits located with each car and proximate to the respective floors, communication with the remote controllers is of fundamental concern since the integrity of hall call signals, and the control strategy in assigning cars to answer these calls, is critical to operational efficiency and to the satisfied customer. Prospective passengers, if possible, should not be aware of or a witness to degradation of service.

One of the principal problems with a distributed control system for controlling a plurality of elevator cars is that normally the remote controller which has been selected for implementing the control strategy is also responsible for checking the integrity of the communication with the other controllers in the system. In some failure modes the other controllers may not be immediately informed and they don't assume the self-selection necessary to begin implementing a master control or other effective strategy remaining available to them such as if there remains good signal integrity between this controller and the hallway serial link of corridor communication.

Another problem is in the situation where there is a failure of the master controller because of one of the hallway serial links becoming interrupted and the remaining controllers become disjointed for the bank of cars because there is no priority of command for controllers. There may be insufficient communication to alert each controller as to the least restrictive operation for each of the controllers in the system. Asserting the authority as master controller by each would result in the potential for multiple car assignments to the same floor unless the remaining controllers continue to communicate with each other without further interruption. Otherwise, all cars going on block operation inexcusably may not be the best car efficiency for the bank of cars which still has the potential for providing more efficient service and to minimize waiting time.

SUMMARY OF THE INVENTION

The present invention is a new and improved elevator system and method of protecting against control signal failures and against excessively restrictive elevator car service, essentially of the type which uses a distributed control system implemented with electronic circuits. These circuits are located with each car of a two-car-pair and at each floor for corridor call information and have input and output signals which are communicated serially for each car over a traveling cable connected to an associated per car remote controller. Each remote controller includes a microprocessor based computer circuit, which is also serially connected over a communication link to the distributed electronic circuits proximate to each floor and serve to implement a two-car-pair floor control (FC) master strategy for responding to hall calls. The remote controllers function individually to respond to the car associated car calls. Each non-FC controller remains on standby to assume implementing the floor control master strategy in an expanded control strategy for answering hall calls, without excessive degradation of service, if the selected floor controller for this responsibility fails or there is a communication failure with it.

The microprocessor for each car repeatedly implements a program with expanded failure modes of operation along with a program to select which remote controller should assume or retain the role of directing the floor control master strategy for the two-car-pair as it signals this status to the other remote controller. This master strategy controller then controls a set of floor control circuits over a serial communication riser for processing the hall calls, and it sends back corridor signals of an audible and visual type which it continues to implement as long as serial riser communication is possible in order to provide service information to a waiting passenger.

Further in accordance with the invention with the expanded failure mode program, when used with an elevator bank consisting of a plurality of two-car-pairs, the microprocessor for each car repeatedly implements an additional program to select which remote controller should assume or retain the additional role of bank control (BC) master which serves as a dispatcher. This BC master functions to supervise all of the cars of the elevator bank in order to process all of the hall calls, and it assigns the best car of those cars remaining under its control for each hall call. The best car to respond is based on the relative car travel position in order to minimize waiting times for service and provide passenger convenience.

The BC master signals its status through a third or multi-car communications link with the other remote controllers and controls the set of floor control circuits through the FC masters over a serial communications riser for each two-car-pair. It determines whether or not to remain active as the dispatcher based on the failure mode program operation. Through its implementation first of the FC master program, the BC master can select itself to serve the dual function as FC master controller for its two-car-pair of the bank. Signal notification thereof is sent, to the other controller over the serial communications link, unless there should be single or multiple communication failures which prevents operation other than as a single car system. This is done if one serial riser has not failed, but otherwise it activates one or more controllers on block operation.

BRIEF DESCRIPTION OF THE DRAWINGS

The invention may be better understood, and further advantages and uses thereof more readily apparent, when considered in view of the following detailed description of exemplary embodiments taken with the accompanying drawings in which.

DESCRIPTION OF A PREFERRED EMBODIMENT

The invention is a new and improved elevator system and a method of operating an elevator system of the type which uses a distributed control system disposed partly in a plurality of elevator cars and partly in an associated plurality of remote controllers disposed therefrom while communicating over a travelling cable serving as a local area network (LAN) using token passing strategies for bi-directional communication. Each car associated remote controller is grouped into a two-car-pair which is serially connected over a communication link to a plurality of distributed electronic circuits proximate to each floor in order to implement a two-car-pair strategy for responding to hall calls, while the remote controllers function individually to respond to their car associated car calls. The remote controllers communicate with each other over a third serial network link so that each remains on standby with respect to the other to assume implementing the floor control strategy in an expanded control strategy, without excessive degradation, should there be a communication failure or failure in the previously established remote controller priority of operation.

The new and improved system and method are described by illustrating only those parts of an elevator system pertinent to the understanding of the invention, and supplemental portions of the elevator system have been incorporated by reference to an allowed U.S. patent assigned to the same assignee as the present application. Accordingly, allowed U.S. patent application Ser. No. 06/829,744 filed Feb. 14, 1986, entitled "Elevator Communication Controller" (W.E. 53,109), describes an addressable elevator communication controller for controlling full duplex serial communication between various remotely located corridor fixtures and car functions in a controller which controls a central bank of elevator cars. Each communication controller may be placed on a single IC custom chip which may be used redundantly in the elevator system in order to control the various corridor fixtures including hall call pushbuttons and associated indicator lamps, up and down hall call lanterns located at each floor, digital or horizontal car position indicators and status panels located at selected floors. It is used as well for elevator car located functions such as the door controller, car position indicator, direction arrows, and the car call pushbuttons and associated indicator lamps.

Figure 1:
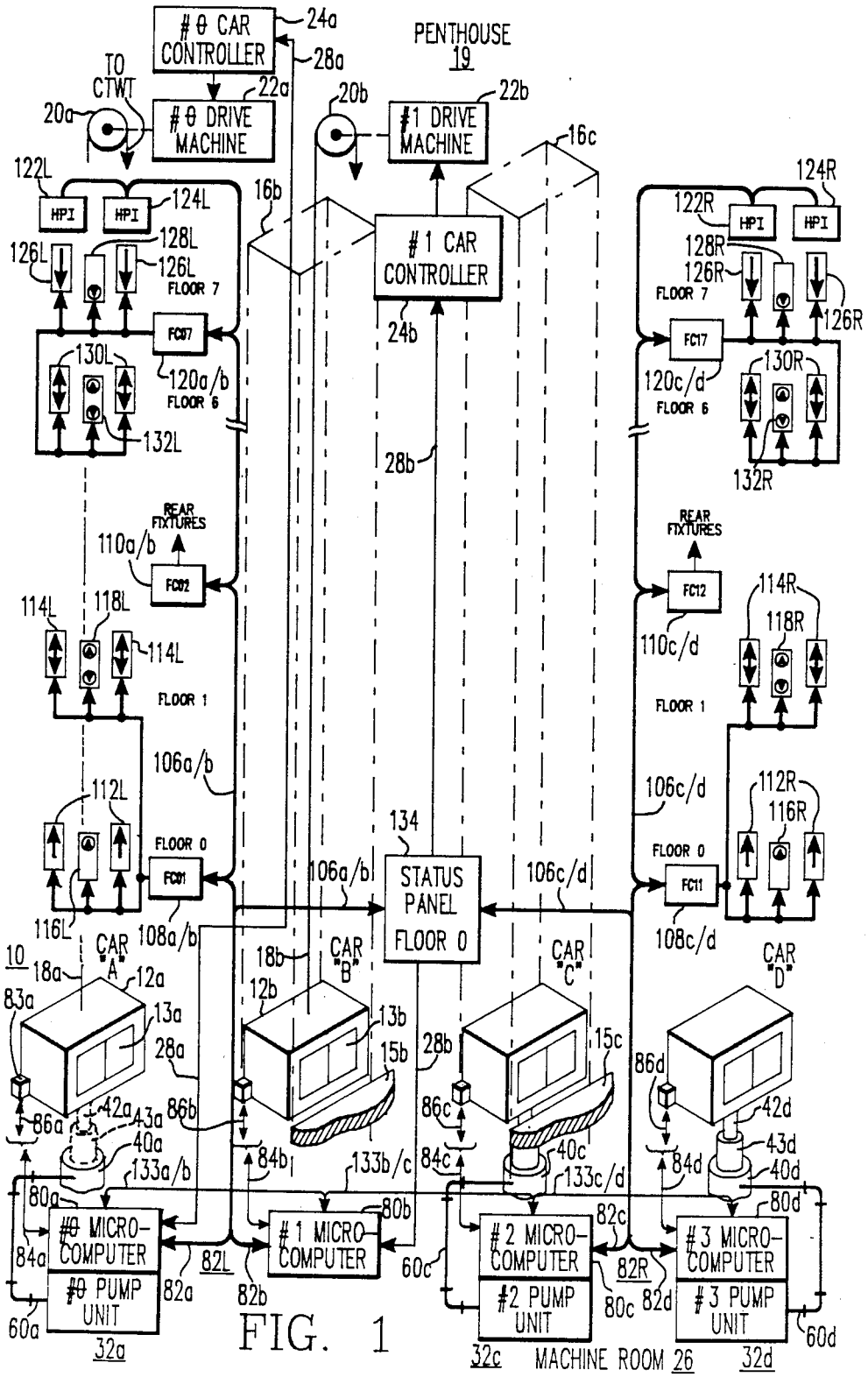
FIG. 1 is a block diagram of a plural car elevator system, shown driven in the alternative with either traction or hydraulic drives and including remote controllers which may be implemented in two-car-pair sets and operated according to the teachings of the invention.

More specifically, FIG. 1 now shows an elevator system 10 which may incorporate this controller which may be utilized according to the teachings of the present invention. The elevator system 10 includes one or more elevator cars, or cabs, such as elevator car 12*a*, the movement of which is alternatively driven either as shown above the car from a penthouse 19 in a building structure (not shown), as in a traction elevator system, or as shown from below the car in a machine room 26, as when the implementation is in a hydraulic elevator system. When the invention is used in a traction elevator system, the car 12*a* is mounted in a hatchway of the building structure, such as shown for car "B", which forms with car "A" a two-car-pair which occupies the space to the left of center in the drawing of FIG. 1. The building structure has a plurality of landings such as the ZERO, 1ST, 6TH, 7TH floors or landings which are shown in order to simplify the drawing.

The car 12*a* is supported by a plurality of wire ropes 18*a* which are reeved over a traction sheave 20*a* mounted on the shaft of a drive machine 22*a* regarded as the #0 drive machine and a counterweight (CTWT now shown) is connected to the other ends of the ropes 18*a*. A similar arrangement is shown for car "B" which is supported by the wire ropes 18*b* over the sheave 20*b* and driven by the #1 drive machine 22*b*. The drive machine 22*a*, 22*b* may be the AC systems having an AC drive motor, or a DC system having a DC drive motor such as used in the Ward-Leonard drive system or it may use a solid-state drive system.

A traction elevator system incorporates a car movement detection scheme to provide a signal for each standard increment of travel of the car such as 0.25 inch of car travel. This may be developed in several ways with one such way using a sensor located on car 12*a* cooperating with indicia disposed in the hatchway. Distance pulses are then developed for a car controller 24*a* which includes a floor selector and speed pattern generator for the elevator system. A further discussion of a car controller and a traction elevator system of the type in which a pulse count is maintained to enable a car to be leveled in the correct travel direction is described U.S. Pat. No. 4,463,833 which is assigned to the assignee of the present application, and the present invention may be used to enhance the functioning thereof.

Normally the car controller 24*a* through its floor selector keeps track of the position and the calls for service for the car 12*a*, and it also provides the starting and stopping signals for the car to serve calls, while providing signals for controlling auxiliary devices such as the door control for the elevator car doors 13*a*. Likewise, the car controller 24*b* for car "B" provides the same functions as the car controller 24*a* does for its respective car "A". In the two-car-pair traction elevator system of the present invention, each of the respective car controllers 22*a* and 22*b* controls hall lanterns such as hall lantern pair of up-floor lanterns 112L associated with the pushbutton 116L at FLOOR 0, and each of the controllers also controls the resetting of the car call and hall call controls when a car or hall call has been serviced. Car 12*b* is shown located at the landing 15*b* with its doors 13*b* shown in a closed position.

The simplification and abbreviation of the elevator system 10 thus far described in FIG. 1 presumes that a traveling cable 84*a* for car "A" and a traveling cable 84*b* for car "B" provide, respectively, bi-directional communication paths to the respective control electronics for each car. Microprocessing control electronics may be located in the penthouse 19 proximate to the car controllers 24*a* and 24*b* or as shown remote therefrom as in FIG. 1 with correspondingly numbered micro-computers #0 and #1 which are located in a machine room 26. In this instance, the #0 micro-computer 80*a* is connected on a car control communication link 28*a* to the car controller 24*a*, and likewise #1 micro-computer 80*b* is connected on a car control communication link 28*b* to the car controller 24*b* in order to provide a complete bi-directional communication path for the cars over the respective traveling cables and car control links.

The traveling cable 84*a* is a composite cable in the sense that a control cable is present therein in order to control certain relay logic functions for the car door operator of car 12*a*, and there is also present a CAR DATALINK 86*a* which is shown emerging from the bottom of car "A" or from a car position terminal 83*a* shown functionally located on the side of the car 12*a*. A similar arrangement for car "B" is intended for the traveling cable 84*b* which is shown for purposes of this description in the same respective alignment with respect to car "B". This provides the proper complement of relay control functions as well as the bi-directional communication paths for the #1 micro-computer 80*b* connected thereto. The conductors in the CAR DATALINK 86*a* are constituted in an arrangement of three pairs of two conductor wires that are twisted and shielded from extraneous noise which might be otherwise inductively coupled to the traveling cable. This cabling is used in order to preserve data quality of the transmission signals and to ensure the credibility of the information received at the circuits in the car as it relates to the control of the car operation through various control circuit boards (not shown herein). Floor circuit boards of the type which may be used in the present invention are disclosed in FIG. 1 of the aforementioned U.S. allowed application Ser. No. 06/829,744, filed Feb. 14, 1986, which is incorporated by reference in the teachings of the present invention.

The description has thus far proceeded on the basis for FIG. 1 that cars "A" and "B" are in a two-car-pair for a traction elevator system with the respective micro-computers 80*a* and 80*b* located remote from the car controllers 24*a* and 24*b* which are shown in the location of the penthouse 19. Also shown in FIG. 1 is the provision for bi-directional communication paths from the micro-computers 80*a* and 80*b* to the various corridor fixtures via a HOISTWAY DATALINK 82*a* and 82*b* which are collectively designated 82L (Left side designation). These may be constituted by three pair of two conductor wires 106*a/b* which are twisted and shielded from extraneous noise and ensure the highest quality of data transmission. Located in the hatchway 16*b* at some appropriate position with respect to the floor 0 and 1ST is shown FC01, a hall fixture circuit board 108*a/b* which interfaces between a pair of upward-pointing floor lanterns 112L for Floor 0 which are associated with an UP pushbutton 116L located therebetween at the same floor location. The hall fixture circuit board 108*a/b* is further connected to communicate with a pair of upward- and downward-pointing floor lanterns 114L for the 1ST floor and also the UP and DOWN pushbutton set 118L positioned therebetween. The corridor location of the leftmost floor lanterns 112L and 114L may be associated with the hoistway location served by car "A", and the floor lanterns to the immediate right side of pushbuttons 116L and 118L are then associated with the corridor location proximate to the hoistway 16*b* served by car "B". The pushbuttons 116L and 118L are displaced on a vertical center line from floor to floor which may be used to serve this two-car-pair of adjoining or spaced hoistways which are not so far physically removed from one another. It is intended that when the invention is used for a two-car-pair the hall fixture circuit board 108*a/b* bi-directionally communicates with all of the associated hallway fixtures in the two-car-pair. With the special arrangement of the present invention, there is a measure of redundancy in the fact that micro-computer 80*a* can provide the complete control over the HOISTWAY DATALINK 82*a* as can microcomputer 80*b* on the hoistway riser 82L.

Another hall fixture circuit board 110*a/b* is also located between the same pair of floors as hall fixture circuit board 108*a/b*, but it is intended for the purpose of serving one or both of these floors, 0 and 1ST, at a rear entrance door or doors of elevator cars 12*a* and 12*b*. Elevator systems with this arrangement are in frequent demand for passenger and rear door freight movement between the floors of many building structures. The rear hall fixture circuit 110*a/b* provides for the same complement of hall fixture signalling and lighted directional indications of pushbuttons and of upward and downward directional arrows as does the hall fixture circuit board 108*a/b*.

Near the top of the hoistway 16*b* is another identical hall fixture circuit board 120*a/b* located at an appropriate position to serve the 6TH and 7TH floors by interfacing the shielded pair conductors 106*a/b* of the hoistway riser 82L, with an upward- and downward-pointing directional pair of floor lanterns 130L and UP and DOWN pushbuttons 132L for the 6TH floor in communication with the hall fixture circuit board 120*a/b*. This is on the same communication circuit as the downward-pointing pair of hall lanterns 126L associated with the DOWN pushbutton 128L of the 7TH floor. The manner of serving the hoistway location of car "A" is with the leftmost directional pair of floor lanterns 130L and 126L and likewise the floor lanterns to the immediate right of pushbuttons 132L and 128L is for car "B" similar to that as for the lower floors previously described. And the same is true for the horizontal position indicator 122L for car "A" on the left and horizontal position indicator 124L on the right for car "B" in order to provide a reading of the location of the respective elevator cars 12*a* and 12*b* during the movement of same so that potential passengers who are waiting at the terminal landings of the building structure are given a fair amount of notice of when to prepare to enter the car when it reaches their respective floor.

Another information display part of the elevator system 10 which is present in a two-car-pair resides in the status panel 134 which is typically provided in a central location of the building structure which may be in the building manager's office or at the concierge's desk in the lobby of the building. The status panel 134 communicates with the micro-computer 80*a* or 80*b* via the conductors 106*a/b* assembled in the hoistway riser DATALINK 82L. This provides a display of position indicators such as LEDs for each elevator car in the two-car-pair 12*a* and 12*b*, along with some status indicators for indicating car position on the floor being served by each elevator car and the direction in which it is proceeding.

The status panel 134 is shown at floor 0, and it is also central to its position for a bank of elevator cars which are formed by a dual two-car-pair with cars "C" and "D" constituting the second two-car-pair. With certain exceptions it should be noted that the two-car-pair to the right of center in FIG. 1 is essentially a mirror image of the various corridor fixtures such as floor lanterns 112R and UP pushbutton 116R (R designated right side) which are controlled by a hall fixture circuit board 108*c/d* which interfaces therebetween. This is at about the same vertical height in the building structure in hoistway 16*c* rather than hoistway 16*b* which provides the location for the hall fixture circuit board 108*a/b*. It is essential to the invention when used in a dual two-car-pair that a second HOISTWAY DATALINK 82*c* and 82*d*, consolidated into the hoistway riser 82R, be used to provide the bi-directional communication over a set of three conductor twisted shielded pair 106*c/d* for the second two-car-pair of cars "C" and "D". This serves the various hall fixtures in the mirror image portion and supplies the status panel 134 with information concerning this two-car-pair. An alternative would be to use a status panel of similar construction but separately located or used, despite the provision of related service with a four car bank of cars being involved.

The present invention described thus far with respect to the showing in FIG. 1 has not made specific reference to the alternative showing of a hydraulic elevator system 10 with the #0 micro-computer 80*a* teamed with a #0 pump unit of a hydraulic power supply 32*a*. The communications described is portable to this type of system with minor changes accordingly. With the hydraulic elevator system 10, equipment in the penthouse 19 such as the drive machine 22*a* and car controller 24*a*, along with the wire ropes 18*a*, sheave 20*a* and CTWT, are likewise absent or removed. Likewise, the car communication link 28*a* between the micro-computer 80*a* and the car controller 24*a* is no longer necessary since the elevator car 12*a* is driven by the hydraulic system from the pump unit 32*a* through supply pipe sections 60*a* to drive a hydraulic jack 40*a* (shown in phantom since considered in the alternative). As shown in phantom for the car "A" the hydraulic system can use multistages 42*a* with 43*a* being the intermediate section thereof. A single acting piston or plunger 42*a* fixed to the underside of the car 12*a* is also sufficient in order to move the car according to the movement of the plunger 42*a*. The base of the jack 40*a* is to be firmly anchored to the base of the building structure or ground. Similarly, hydraulic power supplies 32*c* and 32*d* are respectively designated #2 and #3 pump units all located in the machine room 26 and each is controlled by correspondingly designated micro-computers 80*c* and 80*d*. The hydraulic jacks 40*c* and 40*d* complete the hydraulic drive systems through the supply pipe sections which are appropriately routed and designated 60*c* and 60*d*, respectively.

Although the description does not show that the #1 micro-computer 80*b* in any but a traction elevator configuration, it is not to be regarded as unassailable for the mode of movement by hydraulic means in order to provide a uniform bank of hydraulically driven elevator cars consisting of a dual two-car-pair bank in the preferred embodiment. The versatility of the present invention, however, makes it readily applicable to any two-car or plural two-car-pair which may include matched or unmatched car pairs be they traction elevator or hydraulic elevator car-pairs or otherwise. It is fundamental to the invention, however, that the two-car-pair of cars "A" and "B" are provided with a third bi-directional communication link 133*a/b* connected between their respective micro-computers 80*a* and 80*b* so that they may communicate with each other. One of these two micro-computers can then tell the other that it is the floor control (FC) master of the hallway serial link, meaning bi-directional communication via the hoistway riser 82L, and that the other micro-computer such as 80*b* should remain on standby for the job of FC master of the hallway serial link in case there should be a failure of communication of the micro-computer 80*a*. This is done in order to implement the floor control master strategy for answering hall calls should 80*a* fail or if there is a communication failure such that micro-computer 80*a* cannot communicate with micro-computer 80*b* over the third communication link 33*a/b*.

The invention also provides that if there are two FC masters currently operating redundantly, as micro-computer 80*a* and 80*b*, then the micro-computer having the lower car station address (#0 smaller than #1) micro-computer 80*a* will continue to be the FC master with the micro-computer 80*b* being cleared of this responsibility. A similar third bi-directional communication link is present between the #2 and #3 micro-computers 80*a c* and 80*d* with a similar purpose for the operation of the two-car-pair including cars "C" and "D". Still another third bi-directional communication link 33*b/c* connects the #1 and #2 micro-computers 80*b* and 80*c* in order to provide that each of the micro-computers can talk over this third bi-directional communication link especially those that are the floor control master for the respective hallway serial links 82L and 82R in a dual two-car-pair elevator bank. One of the FC master controllers or micro-computers 80*a* and 80*b* will further assume the additional role as dispatcher or bank control (BC) master which serves as a dispatcher for all of the car associated micro-computer controllers in the elevator bank. This BC master functions to supervise all of the cars and process all of the hall calls in order to select for each hall call the best car to assign to it based on the relative car travel position and in order to minimize waiting times for service and provide passenger convenience that is enhanced.

Figure 2:
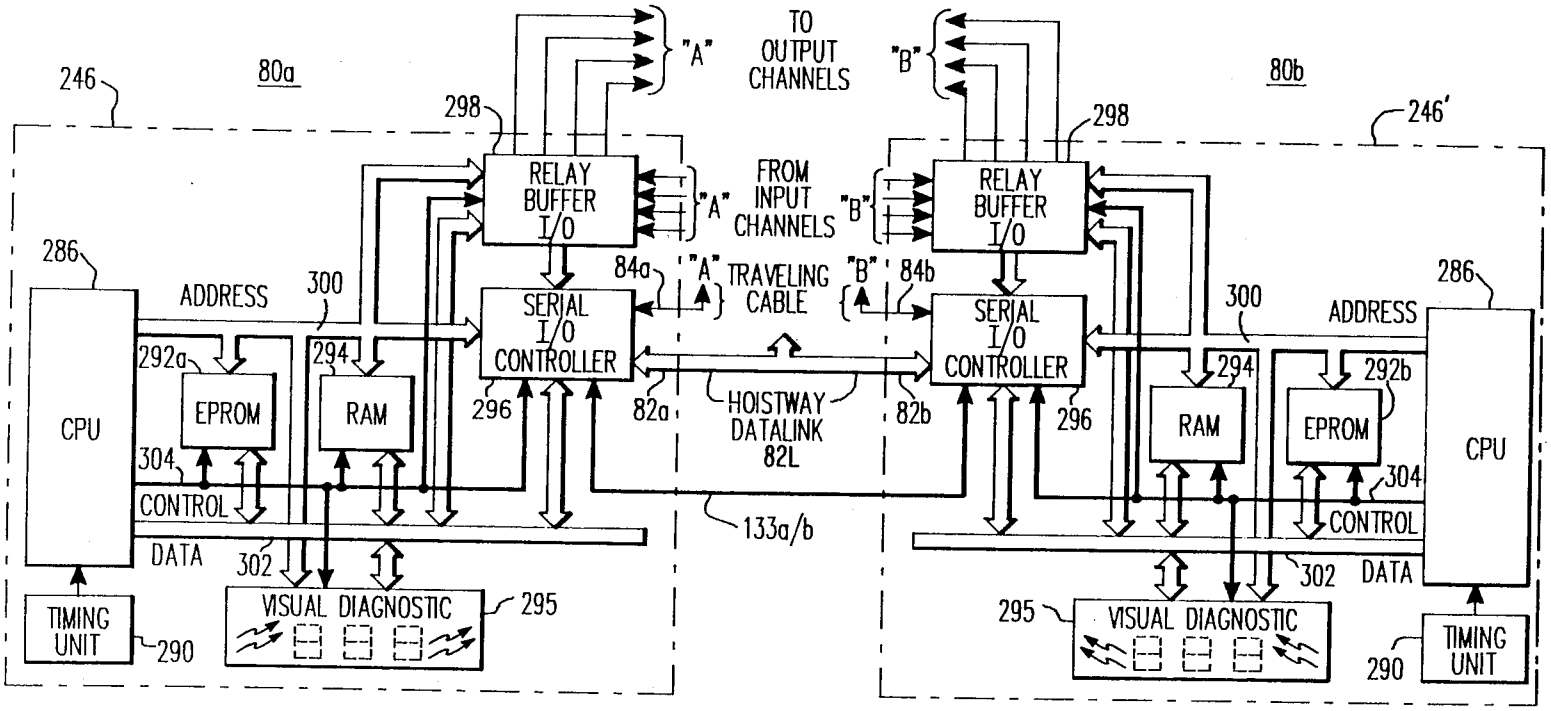
FIG. 2 is a block diagram of a pair of micro-computer circuits each of which are associated with a car and in the elevator system of FIG. 1.

FIG. 2 shows the micro-computer circuit 80*a* located within block 246 on the left side of the page and micro-computer 80*b* within block 246' which is substantially the mirror image of block 246 in order to represent that there is a substantially identical special purpose microprocessor based controller designed to control the overall operation of each car "A" and "B". A substantially similar showing of the micro-computer 80*a* within block 246 has been shown in FIG. 7 of the related U.S. patent application Ser. No. 07/064,913 filed June 19, 1987 and entitled "Elevator System Leveling Safeguard Control and Method" (W.E. 53,784) which has been incorporated by reference into the present application. The last mentioned U.S. patent application describes a car controller which implements program control functions which incorporate elevator safety codes to insure safe operations.

Figure 3:
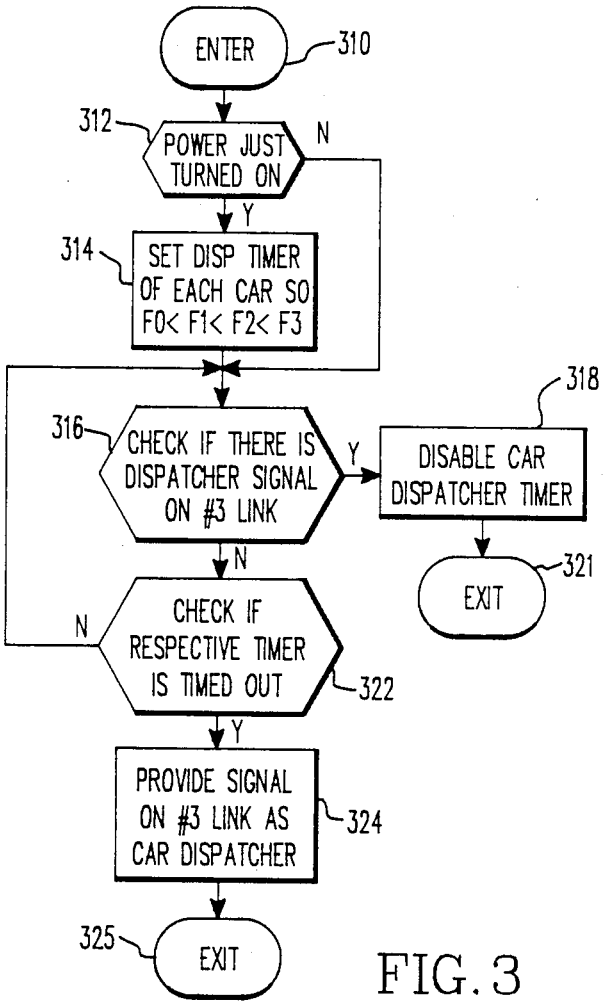
FIG. 3 is a flow chart of an abbreviated program module of the type which may be programmed into the EPROM within each microcomputer circuit of FIG. 2 and run in a repeating sequence in order to switch a dispatcher or bank controller (BC) master strategy for plural two-car-pair sets.

Another slightly modified showing of the micro-computer circuit 80*a* within block 246 was presented in a hydraulic elevator system incorporated by reference into the present application by the showing of FIG. 3 in U.S. patent application Ser. No. 07/064,915 also filed on June 19, 1987 and entitled "Elevator System Monitoring Cold Oil" (W.E. 53,783). Both of these applications are assigned to the same assignee as the present application. This latter referenced U.S. application utilizes the microprocessor within block 246 to implement a program to inactivate an in-service elevator car during which time a hydraulic drive pump is activated to pass oil through a route which bypasses the hydraulic jack in order to bring the hydraulic oil up to an operating temperature to provide smooth starts and prevent damage to the motor and associated equipment.

The present FIG. 2 is substantially similar to the figures mentioned for the incorporated U.S. applications, and the reference to features and the numerals used within blocks 246 and 246' are identical for the most part, with the exception of modified portions which concern the present invention, as will become apparent from the following description. The micro-computer 80*a* controls the overall operation of a car 12*a* such as in the alternative hydraulic elevator system 10 shown in FIG. 1 via the bi-directional communication path in the traveling cable 84*a* and similarly for traveling cable 84*b* and the micro-computer 80*b*. A similar bi-directional communication path for the corridor fixture signalling functions is seen for the HOISTWAY DATALINK 82*a* joined in common with 82*b* which may communicate with either of the identically numbered CPUs 286. These are the respective central processing units either or both of which can receive information through a respective numbered serial input/output controller 296 through an ADDRESS bus 300, DATA bus 302, and CONTROL 304.

The CPUs 286 are both highly-integrated 8-bit units that are designed to operate at 6-MHz operating speed and are of the type available from INTEL with a Model No. 80188. Also in the circuit 246 is the random access memory RAM 294 which can provide 8K bytes of data storage, a portion of which can retain approximately 2K bytes of data in extended long-term storage in the absence of any operating supply voltage except for a long-term shelf life storage battery. An EPROM memory 292*a* is present in circuit block 246 and a similar EPROM 292*b* is present in circuit block 246' with each of these memory devices being split into two sections which can both either be 32K or 16K bytes of the same type of programmable "read only" memory which is available for storage of the main processing functions. The EPROM programs are sequentially stepped through by the respective CPUs 286 as a chain of continuous subroutines for operating the hydraulic elevator system under consideration and its various car signalling, control, and strategy functions as well as for corridor signalling processing functions.

A visual diagnostic module 295 is provided to indicate the status of the micro-computer circuit 246, and along with the respective EPROMs 292*a* and 292*b* and RAM 294, communicate with the respective 286 over the buses 300 and 302 with control from 304 which is likewise used for an input and output of information to devices which communicate with the external portions of the system. Communications networking and higher voltage interfacing is available on relay buffer I/O 298 for the respective input and output channels of cars "A" and "B". A more detailed explanation for these channels is presented in the incorporated U.S. application Ser. No. 07/064,913, filed on June 19, 1987, as previously referenced above.

Figure 4:
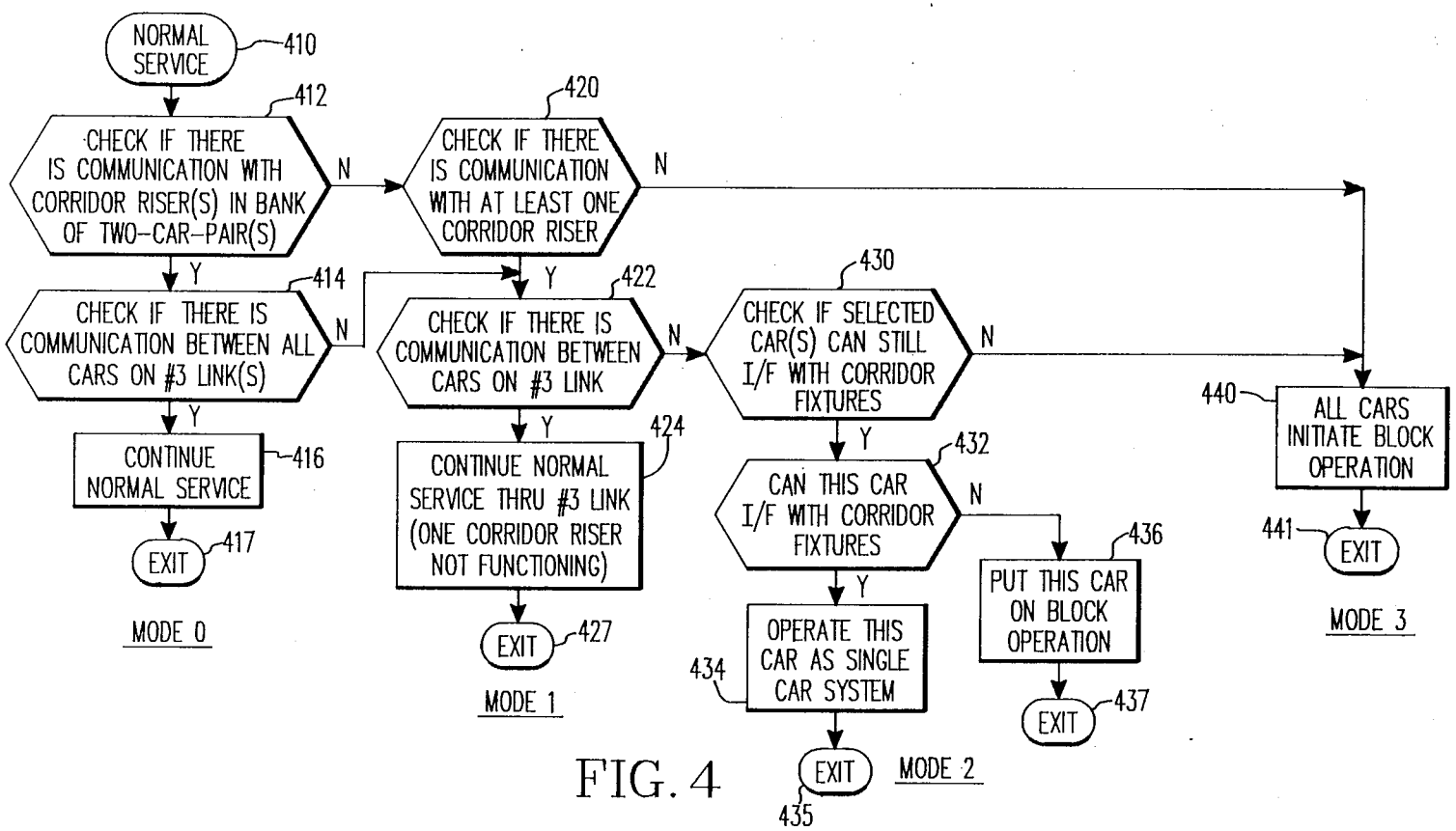
FIG. 4 is a plural mode flow chart of a program module with its associated sequencing routine which is programmed into the respective EPROMs of the microcomputer circuits of FIG. 2 and run in a repeating sequence in order to implement the expanded failure control strategy for servicing hall calls along with car calls.

A serial input/output I/O communication controller 296 in each micro-computer circuit block 246 also communicates on the address bus 300, data bus 302 and control line 304 with its serial interfacing functions being present on the outputs for the respective CAR DATALINKS 86*a* and 86*b* being present in the respective travelling cables 84*a* and 84*b*. Two interdependent floor controller links utilize the respective serial controllers 296 for the HOISTWAY DATALINK with the merger of 82*a* and 82*b* for the HOISTWAY riser 82L. This serves the bi-directional communication path with the appropriately selected floor control (FC) master of the hallway serial link which provides all of the corridor fixture signalling functions such as pushbutton hall calls, visual lanterns, and audible car position signalling. The selection process for the FC master controller will be seen more clearly with respect to the description of the program module FCMHSL with its associated sequencing routine, as shown in FIG. 4 of incorporated by reference U.S. application (W.E. 53,767), which is programmed into respective EPROMs 292*a* and 292*b*. This is shown herein for a two-car-pair elevator system, whether it be driven by a traction drive or implemented with hydraulic power drives. A further description of this pairing of elevator controllers of the same micro-computer construction is not further shown for the car "C" and "D" since it would merely be redundant, with the understanding that the same program modules including FCMHSL are to be resident in the respective EPROMs therein. These programs depend for effectiveness on their taking communication control for the purpose of FC master switching or dominance by one of the micro-computer circuits of each two-car-pair. This is based on the FC master controller with the lower car station address taking priority, unless there is some communication failure on the corrider serial link in which event the associated car may put on block operation as will be further seen with respect to FIG. 4.

The communication between micro-computers 80*a* and 80*b* also includes a third bi-directional communication link 133*a/b* which connects between a remaining capacity for handling multiple communication links by the respective serial I/O controllers 296. Each microprocessor circuit 246 is able to handle multiple communication links of, for example, up to five (5), with certain links being capable of enabling and disabling the drivers so that loading of a single line is avoided. As described with respect to FIG. 1, a similar bi-directional communication link 133*c/d* was said to exist in the manner of communicating between the micro-computers 80*c* and 80*d*. This was also described for the communication linkage 133*b/c* which exists in the dual two-car-pair so that communication between selected remote FC master controllers, such as the 0 and 2 micro-computers 80*a* and 80*c*, can take place during conditions of the normal selection process with unimpaired communications. These are the remote controllers with the respective lower car station addresses relative to the other car station addresses of the two-car-pair sets of remote controllers as previously defined. The provision of the third bi-directional communication links 133*a/b*, 133*b/c*, and 133*c/d*, also provides the proper communication serial path so that the FC master controller can transmit information to its associated remote controller as well as to the FC master of any other two-car-pair of remote controllers, such as over the third bi-direction communication link 133*b/c*.

This communications link also make possible the sharing of one of the selected remote controllers to act as a dispatcher or bank control (BC) master for the switching strategy. This provides that all of the remote controllers can token pass so that each remote controller is given an opportunity to transmit while all the other controllers receive, in a sequential or orderly manner, until the token is given to the next remote controller. This is done in order to communicate such information as the car travel position, the direction of travel up and down, when the car is stopped, and whether the doors of the car are open or in the closed position. This is an RS-485 type of communication protocol which allows the remote controllers to communicate with the corridor fixture through the respective clocking of serial input data ±SID in order to provide the serial output data ±SOD so that the remote controllers can recognize that there is a hall call entered at any of the pushbutton locations such as 118R and FLOOR 1. This will be entered into a Table of Calls, and this information will be communicated to the FC master of #2 micro-computer 80*c* which will communicate this information on the third bi-directional communication links 133*b/c* and 133*a/b*.

The other normally chosen FC master #0 micro-computer 80*a* will also recognize that there is a hall call, and car "A" or "B" controllers will then output a serial message on the HOISTWAY DATALINK 82L so that there will be synchronization between the corridor fixtures 118L and 118R such as lighting and extinguishing the pushbuttons. The same is true with respect to the floor lanterns 114L and 114R during the servicing of the floor 1 since all calls signalled by the dispatcher or BC master direction is a function inherently directable to any one of the micro-computer remote floor controllers. Since each of these remote controllers operate under the same program control, with the exception of priority. The assumption in the floor control strategy is based on the setting of timers for each remote controller in proportion to the car station address so that priority proceeds from the lowest car number to the highest if there is failure in elevator service.

Referring now to the flow chart of FIG. 3 which is an abbreviated program module of the type which may be programmed into the EPROM within each micro-computer circuit of FIG. 2, the CPU 286 begins the serial sequencing at the label 310 and proceeds to make a pass through various decision steps which are contained within a hexagon-like containers such as at 312 and 316 and rectangular-type containers for the action blocks such as 314 and 318 in a traverse of the flow diagram in order to reach a label 321 designated as EXIT. The CPU 286 will proceed to serially step through any relevant program routines which are designated to be sequenced during the time that this module is being run, and the discussion of other modules of this type would present a chain of continuous subroutines for operating the elevator system and its various car signalling, control, and corridor signal processing functions. This extension would unreasonably inflate the description of the present invention beyond the necessity to do so.

The first decision step 312 shown in FIG. 3 checks to see if the power to the elevator system has just been turned on, and since the power has just been turned on at 310, the answer is yes "Y" so the action block 314 sets the DISP timer in RAM 294. This is done in order to provide a program type counter or software counter which may be set at a different value for each remote controller corresponding to the length of time that the timer is to be active before timing out. For example, the minimum timer F0 may be set to 00000111 binary which corresponds to 7 hexadecimal (HEX), also corresponding to DECIMAL 7. A counter may be set to count at 0.5 second intervals, so for counting down from 7, the time it would take would be 3.5 seconds. The #1 remote controller timer F1 may be set for 00001001 binary, corresponding to 9 hexadecimal, also corresponding to DECIMAL 9 and therefore 4.5 seconds for counting down from 9. Likewise in order of increasing magnitude timer F2 represents a count of 5.5 seconds and timer F3 may be set for 6.5 seconds in order to provide a staggered relationship of the type described or otherwise. The DISP timer will each count down from a different value in order to allow the time out of counting from the lowest numbered car to the highest unless there is the disablement of timers which should occur immediately after a dispatchers signal is detected on the #3 link. This corresponds to the multi-car communication link which corresponds to the third bi-directional communication link 133*a/b* in FIG. 2.

After the respective timers have been set, the next decision step 316 checks to see if there is a dispatcher signal on the #3 link. If the answer is affirmative the action block 318 disables the dispatcher timer of this car which has been presumed to be enabled and in the process of counting out since the power was just turned on. This will indicate that a DISP timer which has become disabled is not the minimum timer F0 which would have counted out after 3.5 seconds according to the example. It would be still counting after 3.5 seconds corresponding to the DISP timer's F1, F2, or F3 which correspond to 4.5, 5.5 and 6.5 seconds respectively. Considering that the minimum timer F0 would not be disabled, because of the decision step 316 finding that a negative would be the answer to checking if there is a dispatcher signal on #3 link the DISP timer for the #0 micro-computer 80*a* would proceed to count out through the decision step 322 checking if the respective timer is timed out. The answer is no "N" so proceed to loop back through decision step 316 until the timer F0 is actually found to be timed out by decision step 322 after 3.5 seconds.

The affirmative answer to decision step 322 then proceeds through action block 324 to provide a signal on the #3 link as car dispatcher, and the exit from block 324 is through label 325. This would provide a signal to all of the remote controllers to stop counting out the respective DISP timers at decision step 316 which is being sequenced by each of the remaining micro-computers 80*b*, 80*c* and 80*d* which received the signal on the multi-car communication #3 link and thus proceed with a yes "Y" to the right action block 318 to disable the respective car dispatcher timer before the exit at label 321.

In this manner the remote controller with the #0 micro-computer 80*a* has priority to become the dispatcher or bank control (BC) master of the bank of cars and assigns the car to answer the corridor calls after it calculates which of the cars can get there in the most expedient manner. The dispatcher knows where every one of the elevator cars is located because it communicates with every other microprocessor for the bank of cars in the system, and the invention proceeds in a manner to automatically transfer dispatcher control in a plural two-car-pair elevator system. This occurs upon a continuous communications failure between the remote controller selected to be the dispatcher, originally, and the other cars in the bank. Likewise there is a switching of the dispatcher function upon shutdown of the remote controller that was selected to be the dispatcher. This occurs in an orderly sequence which will be described further.

The description for implementing the floor control (FC) master strategy for servicing hall calls proceeds, according to a similar priority. This priority is based on similar but separate timers utilizing RAM 294 in order to provide a second set of program type counters or software counters which may be set at different values or four different time intervals FC0, FC1, FC2, and FC3, simply by the program insertion of a number of counts corresponding to the length of time that the timer is to be active. The same relative magnitude for the minimum timer FC0 of 3 seconds is chosen as it may be represented in various numbering systems with the counter rate at 0.5 second intervals thereby counting down from DECIMAL 6. The proportional scale in seconds for FC1, FC2, FC3 is likewise chosen to differ from each other by one second respectively and from timers used for the DISP timers thereby 4, 5 and 6 seconds, respectively.

The flow chart of FIG. 4 is a plural mode flow chart of a program module, according to the present invention, which may be programmed into the respective EPROMs 292*a* and 292*b* of the microcomputer circuits of FIG. 2, 80*a* and 80*b*, respectively. It is run in a repeating sequence in order to implement the progressive failure control strategy in conjunction with the running of the car control master strategy and the bank control master strategy as disclosed in the copending U.S. patent application Ser. No. 07/109,638, entitled "Elevator System Master Car Switching" (W.E. Case 53,767) which is incorporated by reference into the present disclosure.

The present invention enhances and expands upon the flexibility of the remote controllers for each of the cars "A" and "B" to communicate with each other over the multi-car communication link 133*a/b*, and likewise, either of the remote controllers 80*a* and 80*b* communicate serially with the hallway fixtures over the consolidated riser 82L through the respective hoistway data links 82*a* and 82*b*. The #0 micro-computer has the priority for fulfilling this serial communication function to efficiently service the corridor call demands, as long as the communication linkages 82*a* and the communication link 133*a/b* with the micro-computer 80*b* has the integrity of its communications function for a two-car-pair system.

Likewise, for the dual two-car-pair in the elevator system bank shown in FIG. 1, the #2 micro-computer 80*c* will assume the priority role for communicating over the hallway serial riser 82*c* in order to fulfill its selection as the FC master controller for the redundant serial hoistway data link 82R. The micro-computer 80*d*, while not selected as the FC master for this two-car-pair, remains ready to provide the fulfillment of this function over the hoistway data link 82*d* and hoistway riser 82R, should the communication capability of the micro-computer 80*c* be impaired in some way that prevents it from communicating as the master of this redundant hallway serial link.

There is a multi-car communication link 133*c/d* which provides a bi-directional communication path in order to provide full information of the current communication status of the FC master 80*c* selected for this two-car-pair. The communication link 133*b/c* provides a fully current status of car "C" on this multi-car link so that car "A", in its capacity as dispatcher or BC master, is given a comprehensive building mosaic of corridor call demands. The servicing capability and assignments for fulfilling these demands is provided for each of the cars in the elevator bank as long as communications do not fail.

The flexibility provided by a distributed processing system of the type described, which may be used for traction and hydraulic elevator systems, is made possible through the remote placement of electronic circuitry in the cars, the hall fixture circuit boards such as 108, 110, for example, and a separate micro-computer for each car is installed in either the penthouse 19 or in the machine room 26. Supplementally, if necessary, a micro-computer may be installed in the car as well to supplement the processing requirements in a traction elevator for a high rise building structure. These systems require communication integrity over the local area networks (LANs) which form a vital part of the operating system via the CAR DATALINKS 86*a*, 86*b*, 86*c*, and 86*d*, the HOISTWAY DATALINKS 82L and 82R, and the multi-car communication links 133*a/b*, *b/c*, and *c/d*.

FIG. 4 provides a flow chart organization showing the vitality of the communication function for the present invention which supersedes the efficiency of the single mode capacity previously recognized for failures. This earlier approach includes only normal service or block operation for the elevator system, in case there should be any vital communication failure therein. An overview of the various modes of operation presented includes Mode 0 for normal service and Mode 1 which continues normal service, although one of the corridor risers 82L or 82R is not functioning. There is continuing operation as a single car system for Mode 2, depending on each car's capability to do so, and this is lastly supplemented by the Mode 3 situation where all cars are to initiate block operation in the event that no car can interface over a communication link with any corridor fixtures.

This expanded and progressive failure control program is sequenced repeatedly by each of the remote controllers in their respective micro-computers 80*a* etc. so that each car controller has the capability of providing the most efficient service. This response is to the respective recognition of corridor call demands as well as to the individual car call initiatives which continue to provide an individual car-by-car response. In this manner, the typical block operation failure mode or emergency thru trip condition, which is constituted by each elevator controller answering a pre-set pattern of fictitious corridor demands, is delayed or permanently avoided. The present inventive strategy is blended with the floor control and bank control master as presented in the strategies incorporated by reference U.S. application Ser. No. (W.E. 53,767) in an expandable and flexible fashion.

The Mode 0 operation for normal service is entered in FIG. 4 at label 410 and is first checked at decision step 412 to see if there is communication with a corridor riser in the bank of two-car-pair controllers. This is within the normal functional capability of an FC master controller, corresponding to micro-computer #0 and #2, for each to check the respective serial corridor risers 82L and 82R. If the communication checking provides an affirmative "Y" then decision step 414 checks if there is communication between all the cars on #3 links which correspond to the multi-car communication links 133*a/b*, etc. which are three in number. So the decision is to continue normal service at the action block 416, after the two decision steps 412, 414 are affirmative, and the exit is at label 417.

The two possibilities of a decision step being answered in the negative, corresponds to one or the other FC master controllers 80*a* or 80*c* turning to the right exit of decision step 412 since each of these controllers has the normal capability of communicating over the respective multi-car links 133*b/c* with each other. The decision step 420 checks if there is communication with at least one of the corridor risers 82L or 82R in the situation where communication with a corridor riser has been determined to provide a negative "N" response to the decision step 412. If communication with one of the corridor risers is still intact, then a respective FC master controller checking same in the affirmative would next check at step 422 if there is communication between two cars on the #3 link, since to continue normal service it must be predicated on the integrity of this communications availability.

The system operation for Mode 1 with at least one corridor riser being functional is for the other controllers to provide sharing of the information from this intact serial riser over the multi-car communication links 133*a/b*, 133*b/c* and 133*c/d*. The only deviation or noticeable difference to the customer or passengers would be that one set of the corridor fixtures, for example, those on the left at floor 7, including DN pushbutton 128L and DN-directional lanterns 126L, would remain functional while the serial riser 82R were experiencing a communication outage. The corresponding pushbutton 128R and lanterns 126R being out of service would not be a hardship of a substantial sort since the alternate fixtures and audible tone of an arriving car with the movement of passengers toward the car reaching floor 7 would attract those passengers. There is only the slight change from their strategic position with respect to the cars on the right portion described for the elevator bank.

A remaining consideration is for the decision step 414, with checks if there is communication between all cars on #3 links for normal service. If there is a communication failure of some of these links, it would affect the control strategy. This relates to a controller need to communicate with the other controllers, the information received on the hallway serial link, and communication with the non-FC master controller for each two-car-pair should not be disrupted. In this eventuality, the negative response to decision step 414 would then be checked at step 422 to see if there is communication between these cars on the #3 link before proceeding to the action block 424, which continues normal service through the #3 link as long as it is functioning while the corridor riser is functioning.

Another tier in the flow diagram of FIG. 4 proceeds to the right if the checking step 422 should find that there is no communication between two cars on the #3 link, since the controller for each of these cars would not be able to communicate with each other. It would normally still be possible for one of these cars to continue to communicate on the hoistway riser since the interface to the corridor fixtures is shared by each two-car-pair of cars such as "A" and "B" and another pair "C" and "D". A checking step 430 is part of the selection used to determine which controller will continue to interface with the corridor fixtures since this program module is being used by each of the participating controllers. A decision step 432 checks to see if this respective car can interface (I/F) with the corridor fixtures which remain in communication over the hoistway riser which is still properly communicating the appropriate signal functions. In the case of two-car-pair "A" and "B", either of which can be selected at decision step 432, the one favored is based on its ability to continue to communicate with the corridor fixtures on hoistway riser 82L. It then passes to the action block 434 with operation of this car as a single car system and exit at label 435.

Only one of the two micro-computers 80*a* or 80*b* is selected to control the corridor interface, and the remaining micro-computer will sense this signal disposition. The decision step 432 for the non-selected car will be negative with exit to the right so that this car will be put on block operation at action block 436. The dicotomy of one car selected continuing to operate as a single car system and the other not being selected to do so still provides the building structure with complete service in the progressive failure control strategy of the present invention. There is not excessive degradation of service since the corridor functions of one of the serial risers 82L or 82R, but not both, are providing the corridor call signalling requirements. The only deviation from normal service perceptible to the customer would be the independence of one serial riser from the other. There is the potential of being able to notice the occurrence of a car on block operation stopping at a floor independent of a corridor call demands. This condition would not be as consequential to the customer or passenger as if all of the cars were degraded to block operation. Then the occurrence of the pattern of cars stopping at floors not demanding service would be far more noticeable and potentially inconvenient since there is efficiency reduction under these circumstances which is a far more noticeable matter.

The remaining Mode 3 would occur over two possible routes as shown in the flow diagram of FIG. 4. One entry is through the first decision step 420 of Mode 1 checking if there is communication with at least one corridor riser and having a negative "N" passage to the right. This goes directly into the action block 440 in which all cars initiate block operation in a collective fashion in order to bring the passengers down to the bottom floor, and the program proceeds to exit at label 441 with a block operation program having been initiated. It can also occur on an individual car controller basis by putting each car on block operation according to signal activity of a problematic kind being received on a hallway serial signal link by an individual controller. This is in the process of a controller being rejected for the role of FC master of the hallway serial link, as it cannot so function under these circumstances.

The other manner in which Mode 3 engages the action of block operation 440 for all cars is if a negative response is found for the decision step 430 in checking if a selected car or cars can still interface with corridor fixtures. Without this communication interface of either car or any car in a plural two-car-pair bank of cars, it is not possible for any car to act as a single car system in Mode 2. That is why the negative exit at decision step 430 will initiate that all cars go on block operation at block 440. The building, however, will still be totally serviced to move all the passengers to the bottom floor with all cars on block operation. The service in this mode is less efficient than the others in terms of time and delivery of passengers and it is more noticeable. It is thus reserved for last in this desired system for interfloor hall call traffic.

The transition of elevator passengers can be facilitated to the full measure with all of the advantages of distributed processing configurations realized by the present invention, progressively, and in a manner which increases the reliability and fault tolerance of the elevator system which is one of the dominant features of the present invention.

We claim as our invention:

1. A method of controlling a plurality of elevator cars for providing continuous and less noticeably restricted elevator service to each floor of a building, with each car having its car call signals communicating on a local area network from an electronic circuit located with each car through a separate traveling cable to a remote controller, each remote controller including a microprocessor based computer circuit individual to each car and with each remote controller also communicating corridor signal information on a local area network through a riser cable terminating in a set of floor control circuits distributed proximate to each floor, each said microprocessor based computer circuit being inherently capable of implementing progressive failure control modes interactive with a floor control strategy to assign the better car or cars into operation, based on communication network integrity, relative car travel positions and timing, to respond to the hall calls registered at the floors along said cable riser, each said remote controller, concurrently with its response in the strategy for hall calls, controlling the car response individual to its registered car calls for service to the floors, and each said remote controller repeatedly checking its operational capability and communication signal integrity on the corridor cable riser so as to be available to assume implementing the least restrictive failure control mode for the floor control strategy should there be a failure affecting the remote controller priority of operation.

2. The method of claim 1, wherein the step of each remote controller microprocessor based computer circuit communicating corridor signal information over a local area network is implemented by bidirectionally communicating in serial signal transmission format through the riser cable or hallway serial link for so long as it is a viable network, as determined by the checking step for implementing the floor control strategy to respond to the registered hall calls.

3. The method of claim 1, wherein said plurality of elevator cars is in a two-car-pair operating system and each car with its associated remote controller microprocessor based computer circuit is capable of singularly implementing an expanded floor control (FC) master strategy inherent to the hall call response for said two-car-pair, after a remote controller is selected by said repeated checking step, the selected controller implementing the floor control strategy by assigning the better car or both cars into operation to respond to the hall calls registered at the floors, for so long as a communication path is viable, while controlling the car response individual to its car calls local to the car.

4. The method of claim 1, wherein said plurality of elevator cars is in an operating system including a plurality of two-car-pair sets of cars, and each car within each set is associated with a remote controller microprocessor based computer circuit which is capable of singularly implementing an expanded bank control (BC) master strategy inherent to the hall call response for said plural two-car-pair operating system after a remote controller is selected by said repeated checking step, the selected controller becoming BC master and implementing the floor control strategy by assigning the best car or cars into operation to respond to the hall calls registered at the floors for so long as a communication path is viable, while controlling the car response individual to its car calls from the associated car.

5. The method of claim 1, wherein said plurality of elevator cars is in an operating system including a plurality of two-car-pair sets of cars and each car within each set is associated with a remote controller microprocessor based computer circuit which is capable of singularly implementing an expanded floor control (FC) master strategy and an expanded bank control (BC) master strategy for the hall call response for said plural two-car-pair operating system, after a remote controller is selected by said repeated checking step in each respective two-car-pair set in order to provide a respective FC master in each two-car-pair set, then continuously checking if multi-car communication is operational between the FC master of one and the other two-car-pair, and if failing this then checking if communicating on a third local area network between remote controllers of each two-car-pair if non-operational, thereupon checking if the FC master of the remaining two-car-pair is operational to thereby assign the BC master strategy to this remaining FC master unless it is not operational, whereupon the FC master assignment is transitioned to the other remote controller of the remaining two-car-pair to implement the floor control strategy, for so long as multi-car communication is viable, while controlling the car response individual to its car calls from the associated car.

6. A control system for controlling a plurality of elevator cars to provide less noticeably restricted and continuous elevator service to each floor of a building, comprising:

a first local area network for each car having its car call signals communicating thereon and including an electronic circuit located with each car connected to a remote controller on a traveling cable, each remote controller including a microprocessor based computer circuit, for the car, a second local area network for each remote controller to communicate corridor signal information through a riser cable terminating in a set of floor control circuits distributed proximate to each floor, each said microprocessor based computer circuit being adapted to implement progressive failure control modes interactively with a floor control strategy to assign the better car or cars into operation, based on communication network signal integrity, relative car travel positions and timing, to respond to the hall calls registered at the floors along said cable riser, each said remote controller, concurrently with its strategy for answering hall calls, controls the car response individual to its registered car calls for service to the floors, and each said remote controller computer circuit including means for repeatedly checking its operational capability and the communication signal integrity on the corridor cable riser within the control system so as to be immediately available to assume implementing the least restricted failure control mode for the floor control strategy should there be a failure affecting the remote controller priority of operation.

7. The control system of claim 6, wherein each car serially communicates with its respective remote controller over the local area network implemented by bi-directionally communicating in serial signal transmission format over its respective traveling cable, for so long as network signal viability exists, the information relating to car call registration and the responsive car travel transition.

8. The apparatus of claim 6, wherein said plurality of elevator cars is in an operating system including a plurality of two-car-pair sets of cars and each car within each set is associated with a remote controller, microprocessor based computer circuit which is capable of singularly implementing an expanded bank control (BC) master strategy inherent to the hall call response for said plural two-car-pair operating system, after a remote controller is selected by said means repeatedly checking its operational capability, the selected controller becoming BC master and implementing the floor control strategy by assigning the best car or cars into operation to respond to the hall calls registered at the floors, for so long as a communication path is viable, while controlling the car response individual to its car calls from the associated car.

9. The control system of claim 6, wherein each remote controller microprocessor based computer circuit is adapted for serially communicating corridor signal information over the local area network is implemented by bi-directionally communicating in serial signal transmission format through the riser cable or halllway serial link for so long as it is a viable network, as determined by the checking means for implementing the floor control strategy to respond to the registered hall calls.

10. The control system of claim 9, wherein said plurality of elevator cars is in a two-car-pair operating system and each car associated microprocessor based computer circuit is capable of singularly implementing an expanding floor control (FC) master strategy inherent to the hall call strategy for said two-car-pair after a remote controller is selected by said means repeatedly checking its operational capability, the selected controller implementing the floor control strategy by assigning the better car or both cars into operation to respond to hall calls registered at the floors for so long as a commuication path is viable, while controlling the car response individual to its car calls local to the car.

* * * * *